US008292591B2

(12) United States Patent
Leso et al.

(10) Patent No.: US 8,292,591 B2
(45) Date of Patent: Oct. 23, 2012

(54) ADJUSTABLE SANITARY IMPELLER HUB

(75) Inventors: Michael John Leso, Clark, NJ (US); Jeffrey David Watkins, Watchung, NJ (US)

(73) Assignee: New Brunswick Scientific Co., Inc., Enfiled, CT (US)

( * ) Notice: Subject to any disclaimer, the term of this patent is extended or adjusted under 35 U.S.C. 154(b) by 453 days.

(21) Appl. No.: 12/602,697

(22) PCT Filed: May 23, 2008

(86) PCT No.: PCT/US2008/064757

§ 371 (c)(1), (2), (4) Date: Dec. 2, 2009

(87) PCT Pub. No.: WO2008/148037

PCT Pub. Date: Dec. 4, 2008

(65) Prior Publication Data

US 2010/0178170 A1 Jul. 15, 2010

Related U.S. Application Data

(60) Provisional application No. 60/939,690, filed on May 23, 2007.

(51) Int. Cl.
*F04D 29/34* (2006.01)

(52) U.S. Cl. ..... 416/204 R; 416/244 R

(58) Field of Classification Search ..... 416/204 R, 416/204 A, 244 A
See application file for complete search history.

(56) References Cited

U.S. PATENT DOCUMENTS

| | | | | |
|---|---|---|---|---|
| 3,811,716 | A | 5/1974 | Morzynski | |
| 3,937,595 | A | 2/1976 | English et al. | |
| 3,975,113 | A | 8/1976 | Ogles | |
| 2003/0118461 | A1 | 6/2003 | Hodapp et al. | |
| 2006/0147259 | A1 * | 7/2006 | Hu et al. | 403/343 |

FOREIGN PATENT DOCUMENTS

| | | | |
|---|---|---|---|
| KR | 1020010010870 | A | 2/2001 |
| KR | 1019970059512 | B1 | 4/2005 |

* cited by examiner

*Primary Examiner* — Richard Edgar
(74) *Attorney, Agent, or Firm* — Fox Rothschild LLP; Richard C. Woodbridge; Ryan Miller

(57) ABSTRACT

An adjustable sanitary impellor hub device having a hub, a tapered, split collet, a locking collar and multiple seals. Impeller blades are attached to a hub that may be slid over an agitator shaft to a desired position. A tapered, split collet engages with a tapered inner cylindrical bore of the locking collar as the locking collar and hub are forced together, clamping the collet to shaft. At the same time, the outer surface of the locking collar engages with the hub, locking all three elements to the shaft. The multiple soft seals ensure that there are no dead spaces.

2 Claims, 3 Drawing Sheets

ADJUSTABLE SANITARY IMPELLER HUB

CROSS REFERENCE TO RELATED APPLICATIONS

The present application is a 35 U.S.C. §371 National Phase application of International Application Serial No. PCT/US 2008/064757 filed May 23, 2008, which is related to, and claims priority from, U.S. Provisional Patent application No. 60/939,690 filed on May 23, 2007 by Leso et al. titled "Adjustable Sanitary Impeller Hub Design", the contents of which are hereby incorporated by reference.

TECHNICAL FIELD

The present invention relates to impellers, and more particularly to hubs for adjustable sanitary impellers.

BACKGROUND ART

This invention relates to the hub assembly of an impeller. Impellers are a component of an agitator assembly which is used to mix fluids. The impeller may be secured to the agitator shaft at various locations within a container or vessel. Multiple impellers may be mounted on a single shaft.

The impeller consists of a hub assembly, which secures the impeller to the agitator shaft, and a set of radial blades which extend outward from the hub assembly. The agitator shaft is driven rotationally, which moves the blades through the fluid, thus mixing the container contents.

In certain industries, the fluid contents of the container may come in contact with animals or humans. The equipment designed to produce such material must be sanitary or hygienic in design. The definition of such a design is that it must be cleanable, sterilizable and free of dead spaces or crevices.

Traditional adjustable impeller designs are not suitable for use in sterile equipment as they typically contain threads from screws or crevices which do not comply with hygienic design standards. Impeller hubs used in such sterile equipment are, therefore, typically welded to the shaft in order to seal all dead spaces. This does not allow the user the ability to change the location of the impeller assembly.

DISCLOSURE OF INVENTION

Briefly described, the invention provides an adjustable sanitary impellor hub device.

In a preferred embodiment, the hub assembly consists of a hub, a shaft collet, a locking collar and multiple seals. The hub, to which impeller blades may attached, may be slid over the shaft to the desired position. A seal may be mounted on the inner diameter of the hub as part of the sealing all crevices. The hub also has a portion which connects to the locking collar. The shaft collet is a tapered collar that slides over the shaft and exerts a strong clamping force on the shaft when it is tightened between the hub and locking collar. The locking collar slides over the shaft and is secured to the hub.

When the locking collar is tightened onto the hub, it causes the collet to clamp onto the shaft. A seal is mounted on the inner diameter of the locking collar in order to help isolate all crevices. A seal may also be located in the joint between the locking collar and hub.

BEST MODE FOR CARRYING OUT THE INVENTION

The present invention applies to sanitary impeller hub assemblies that may be mounted on a shaft at any location. Once the impeller is located in place, the hub assembly is tightened in order to lock the impeller to the shaft and seal all dead space on the hub assembly. It can then be easily loosened and moved to another location in order to optimize mixing, while maintaining the hygienic design aspect.

The assembly consists of a hub, a shaft collet, a locking collar and multiple seals. The hub, to which impeller blades may attached, may be slid over the shaft to the desired position. A seal may be mounted on the inner diameter of the hub as part of the sealing all crevices. The hub also has a portion which connects to the locking collar. The shaft collet is a tapered collar that slides over the shaft and exerts a strong clamping force on the shaft when it is tightened between the hub and locking collar.

The locking collar slides over the shaft and is secured to the hub. When the locking collar is tightened onto the hub, it causes the collet to clamp onto the shaft. A seal is mounted on the inner diameter of the locking collar in order to help isolate all crevices. A seal may also be located in the joint between the locking collar and hub.

A preferred embodiment of the invention will now be described in detail by reference to the accompanying drawings in which, as far as possible, like elements are designated by like numbers.

Although every reasonable attempt is made in the accompanying drawings to represent the various elements of the embodiments in relative scale, it is not always possible to do so with the limitations of two-dimensional paper. Accordingly, in order to properly represent the relationships of various features among each other in the depicted embodiments and to properly demonstrate the invention in a reasonably simplified fashion, it is necessary at times to deviate from absolute scale in the attached drawings. However, one of ordinary skill in the art would fully appreciate and acknowledge any such scale deviations as not limiting the enablement of the disclosed embodiments.

Figure 1:
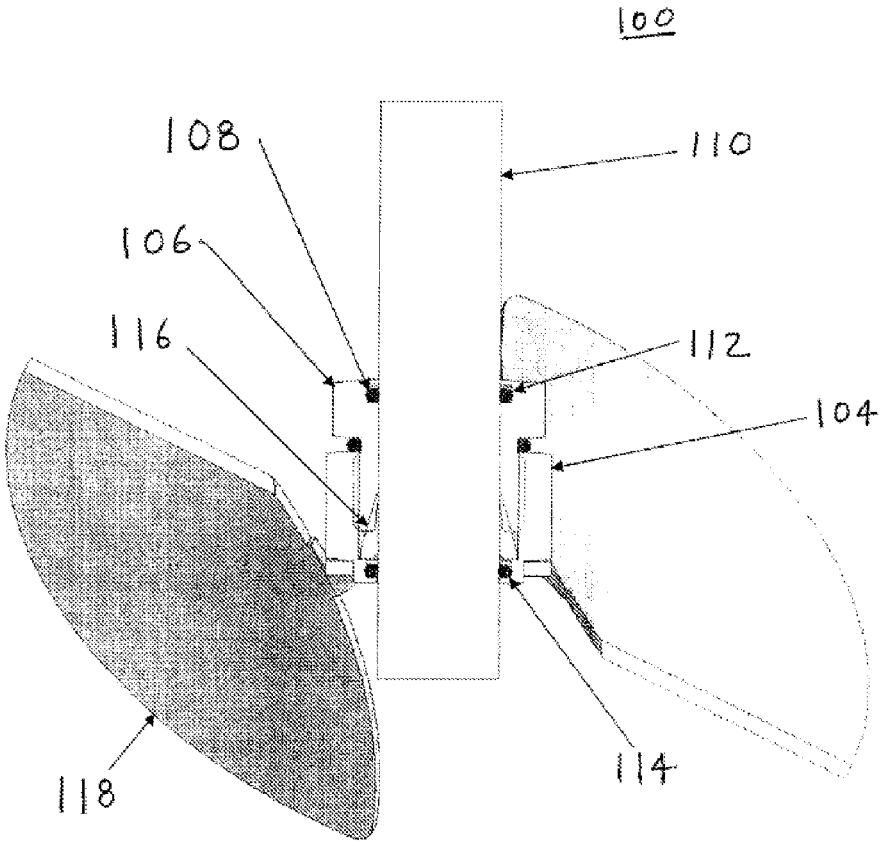
FIG. 1 is a cross-section of an exemplary hub assembly in accordance with the present invention.

FIG. 1 is a cross-section of an exemplary hub assembly 100 in accordance with the present invention.

The hub assembly 100 attaches to an agitator shaft 110, and includes a hub 104, a shaft collet 116, a locking collar 106, a locking collar seal 108, a hub seal 114 and a hub assembly seal 112. At least one impeller blade 118 may be attached to the hub 104.

Figure 2:
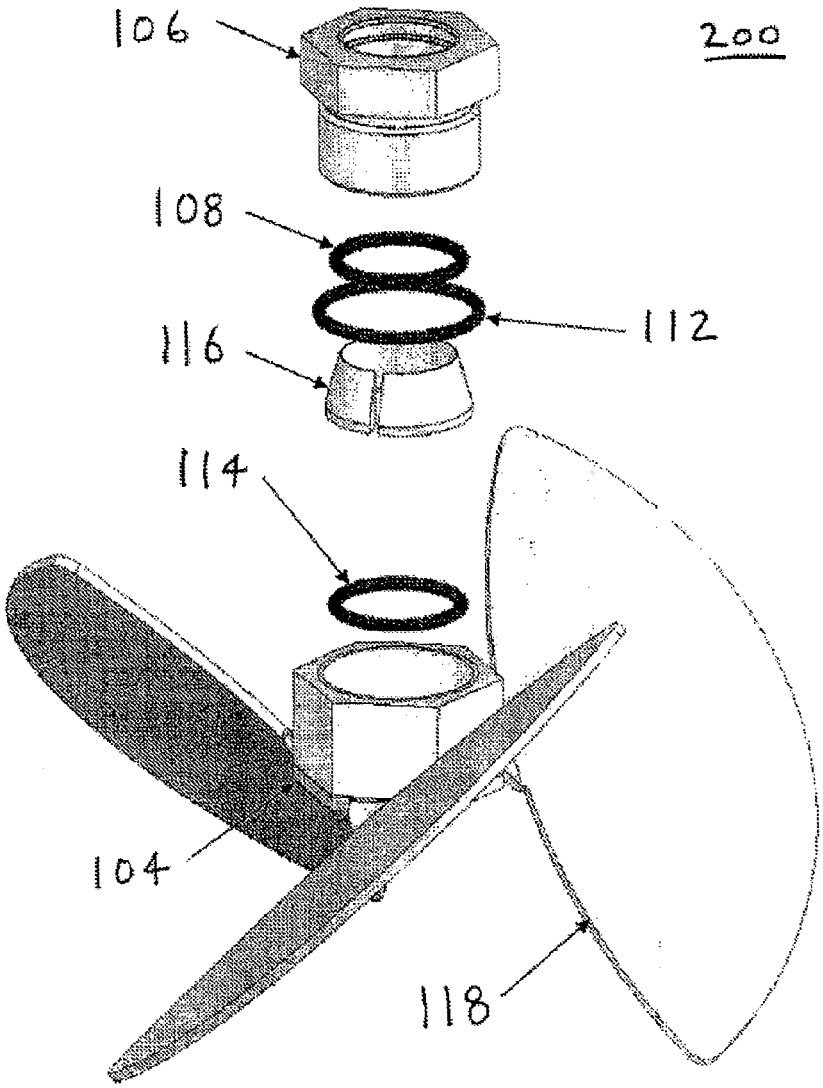
FIG. 2 is a three-dimensional exploded view of an exemplary hub assembly in accordance with the present invention.

FIG. 2 is a three-dimensional exploded view 200 of an exemplary hub assembly in accordance with the present invention. The exploded view shows the structure of the hub 104, the shaft collet 116, the locking collar 106, the a locking collar seal 108, the hub seal 114 and a hub assembly seal 112.

Figure 3:
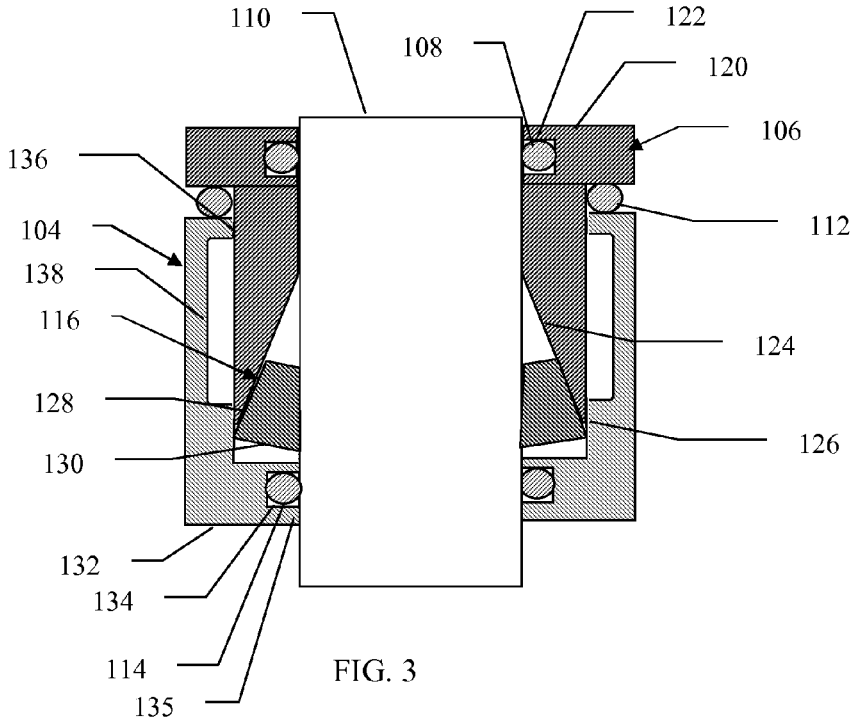
FIG. 3 is a cross-section of a further example of a hub assembly in accordance with the present invention.

FIG. 3 is a cross-section of a further example of a hub assembly 100 in accordance with the present invention.

The hub 104 has a cylindrical bore 135 that extends from one end of the hub 104, and a second wider, cylindrical bore 136 that extends from the other end of the hub 104 to the first cylindrical bore 135. There may also be a further relieving cylindrical bore 138.

The cylindrical bore 135 has a hub seal groove 134 that retains the hub seal 114.

The split shaft collet 116 has tapered outer surface 128 and a wider end 130.

The locking collar 106 has a tapered bore 124 that extends from a thin end of the collar 126 to a cylindrical bore, similar in diameter to the outer diameter of the agitator shaft 110, that extends from the locking collar's wider end 120. The locking collar 106 also has a locking collar groove 122 that retains the locking collar seal 108.

As discussed in detail in, for instance, co-pending PCT patent application PCT/US08/54653 entitled "Torsionally flexible sealed drive" filed on Feb. 22, 2008 by Watkins et al., the contents of which are hereby incorporated by reference, the components of the hub assembly 100 may need to be sterilized and are, therefore, preferably made of materials that can be sterilized such as, but not limited to, stainless steel or rigid plastics such as polycarbonate or ABS rubber, or combinations thereof The locking collar seal 108, the seal hub assembly seal 112 and the hub seal 114 may be made of flexible plastic such as, but not limited to, polyethylene, polyurethane, santoprene or flexible vinyl, or combinations thereof.

In a preferred embodiment, the hub assembly 100 may be used as follows. The hub 104 is slidably moved to the required location on the agitator shaft 110. The split shaft collet 116 is located around the agitator shaft 110 with a wider end 130 of the split shaft collet 116 adjacent to the end of the hub 132 that contains a hub seal groove 134. The locking collar 106 is then moved into place so that the tapered bore 124 of the locking collar 106 engages the tapered outer surface 128 of the split shaft collet 116. As the locking collar 106 and the hub 104 are forced together, the tapered bore 124 of the locking collar 106 acts as a wedge and locks the split shaft collet 116 against the agitator shaft 110. At the same time the thin end of the collar 126 locks against the second wider, cylindrical bore 136 of the hub 104, holding everything firmly in place.

To adjust the position of the hub assembly 100, the locking collar 106 and the hub 104 are pulled or twisted apart. The hub 104 and the locking collar 106 may, for instance, have hexagonal shaped outer surfaces to facilitate the use of tools to apply the twisting force for locking and unlocking the hub assembly 100.

Although the invention has been described in language specific to structural features and/or methodological acts, it is to be understood that the invention defined in the appended claims is not necessarily limited to the specific features or acts described. Rather, the specific features and acts are disclosed as exemplary forms of implementing the claimed invention. Modifications may readily be devised by those ordinarily skilled in the art without departing from the spirit or scope of the present invention.

Industrial Applicability

In the fields of pharmaceuticals and biotechnology there is significant interest in adjustable, sanitary impeller hubs for use in sterile mixing reactors.

What is claimed:

1. An adjustable sanitary impeller hub device, comprising:

a hub having a first cylindrical bore extending from a first end of said hub and a second, wider cylindrical bore extending from a second end of said hub to said first cylindrical bore, said first cylindrical bore having a diameter substantially equal to an outer diameter of an agitator shaft and being adapted to retain a first compressible seal between the inner surface of said first cylindrical bore and the outer surface of said agitator shaft;

a split shaft collet having a tapered outer surface and being fitted around said agitator shaft within said second cylindrical bore; and a locking collar having a tapered bore extending from a first end of said collar to a third cylindrical bore extending from a second end of said collar, said locking collar being adapted to retain a second compressible seal between the inner surface of said third cylindrical bore and the outer surface of said agitator shaft, and slidably moveable along said agitator shaft so an inner surface of said tapered bore engages with said tapered outer surface of said split shaft collet, while an outer surface of said locking collar engages with a portion of said wider, second cylindrical bore of said hub, thereby temporarily locking said impeller hub assembly to said agitator shaft.

2. The device of claim 1 further comprising a third compressible seal is retained between said second end of said hub and an outer shoulder between a first outer surface of said locking collar and a second, wider outer surface of said locking collar.

* * * * *